United States Patent [19]

Ward et al.

[11] Patent Number: 4,813,357

[45] Date of Patent: Mar. 21, 1989

[54] METHOD AND APPARATUS FOR SPLICING CONTINUOUS PIN-FEED FORMS

[75] Inventors: Leonard G. Ward; T. Craig Nelson, both of Melbourne, Fla.

[73] Assignee: Storage Technology Corporation, Louisville, Colo.

[21] Appl. No.: 43,604

[22] Filed: Apr. 28, 1987

[51] Int. Cl.[4] ..... B31F 5/00; B41L 1/32

[52] U.S. Cl. ..... 101/426; 270/39; 156/502; 156/504; 156/505; 156/506; 156/507; 101/228; 101/238; 226/11; 226/45; 242/58.5; 242/59; 400/708; 400/708.1

[58] Field of Search ..... 270/39; 101/426, 219, 101/224, 226, 228, 238, 181; 156/504–507, 157, 159, 544–545, 502; 226/11, 195, 45; 242/58.5, 59; 493/350; 400/708, 708.1

[56] References Cited

U.S. PATENT DOCUMENTS

| | | | |
|---|---|---|---|
| Re. 31,210 | 4/1983 | Lapp et al. | 226/119 |
| 3,123,268 | 3/1964 | Gagg | 226/45 X |
| 3,631,972 | 1/1972 | Gendron et al. | 270/39 |
| 3,776,795 | 4/1973 | Stevenson | 156/505 |
| 3,829,080 | 8/1974 | Braen et al. | 270/39 |
| 3,928,844 | 12/1975 | Meihofer | 101/226 |
| 3,946,919 | 3/1976 | Ernst | 226/11 |
| 3,976,235 | 8/1976 | Baldyga et al. | 226/11 |
| 4,056,426 | 11/1977 | Sipin | 156/505 |
| 4,068,565 | 1/1978 | Olsen et al. | 493/350 |
| 4,239,582 | 12/1980 | McGrath | 156/505 |
| 4,252,597 | 2/1981 | Monroe | 156/157 |
| 4,256,248 | 3/1981 | Lapp et al. | 226/118 |
| 4,289,556 | 9/1981 | Booth | 156/506 |
| 4,375,189 | 3/1983 | Bernier | 226/195 X |
| 4,525,399 | 5/1985 | Fields | 428/43 |
| 4,564,184 | 1/1986 | Rumpel | 270/39 |
| 4,573,409 | 3/1986 | Clar et al. | 101/426 |

OTHER PUBLICATIONS 3-page Acme Visible brochure entitled, "IBM 3800 Users-Continuous Forms-Feeding for Non-Stop Laser Printing", 1980.

*Primary Examiner*—Eugene M. Eickholt

*Attorney, Agent, or Firm*—Woodcock Washburn Kurtz Mackiewicz & Norris

[57] ABSTRACT

A method and apparatus for splicing a fresh stack of continuous pin-feed forms in a high-speed printer having fed therethrough an expended stock of continuous pin-feed forms, where the printer includes an input station at a recessed area. A slidable tray for supporting the fresh stack is pulled out of the printer, and a splicing station which is hingedly coupled to an upright wall portion attached to the tray is deployed external to the printer for splicing ease. The splicing station includes a spool of splicing tape which is disposed within a locating groove of a controlled depth, the forms being registered on locating pins on either side of the groove for accurate splicing upon pressing them centered on the tape. When the splice is complete, the spliced stack is fan-folded upon the tray, the splicing station folded back against the upright wall portion, and the tray returned within the recessed area.

30 Claims, 8 Drawing Sheets

METHOD AND APPARATUS FOR SPLICING CONTINUOUS PIN-FEED FORMS

BACKGROUND OF THE INVENTION

This invention relates generally to printers utilizing continuous pin-feed forms, and more particularly to a method and apparatus for splicing said forms within such printers.

High-speed laser electrographic printers, such as the IBM 3800, are often used to process large printing jobs for institutions such as banks. The process of feeding paper to such high-speed printers, or other machines which continuously process paper or other webbed materials at high speeds, has been typically accomplished by supplying a continuous web of material to the printer or processing machine and providing means for continuous removal and collection of the processed web. Some such machines are so constructed and operated to permit the continuous feeding and removal of the web with no down-time required to perform paper handling tasks.

The IBM 3800, however, like other such high-speed printers being operated today is not capable of being fed a continuous web of paper, but instead is normally operated by supplying a stack of folded web sheets, running the printer to process the stack, and then stopping the printer to take out the processed stack, the sequence being repeated as necessary to complete the printing job. Such high-speed printers conventionally have paper feed apertures and discharge apertures positioned in recesses within the machine which make the continuous feeding and removal of the paper virtually impossible. Similar such printers are also produced by Storage and Technology Corporation as the 6100 Printing Subsystem. Further information pertaining to the IBM 3800 printer and related support systems is available in the IBM publication GA32-0049-3, "IBM 3800 Printing Subsystem Models 3 and 6 Introduction," GA32-0050-2, "Reference Manual for the IBM 3800 Printing Subsystem Models 3 and 6," GA 32-0068-2, "IBM 3800 Printing Subsystem Models 3, 6, and 8 Operator's Guide," and GH20-9158-6, "Document Composition Facility General Information," which are incorporated herein by reference. As well, further information pertaining to the 6100 Printing Subsystem and related support systems is available in the Storage Technology Corporation publications P/N 3825131501B, "6100 Printing Subsystem Paper Specification Manual," P/N 3825131601, "6100 Printing Subsystem Form Design Guide," and P/N 3825118701, "6100 Printing Subsystem Operators Manual and Product Description Manual," each of which is incorporated herein by reference.

One problem typically encountered in any of the above described printers is the necessity to splice a fresh stack of continuous pin-feed forms to the expended stack of continuous pin-feed forms previously processed through the printer. For example, splices must be made carefully because they are critical to good machine performance. If a paper jam results from a poor splice, care must be taken to remove all pieces of tape and its adhesive residue from the machine, especially from the transfer station, fuser station, and continuous forms stacker. Paper jams may result from two basic causes. That is, if the length of tape used to splice the forms is longer than the width of the forms themselves, a potential exists for the tape or its adhesive to jam the printer as discussed immediately herein above. On the other hand, if the length of tape used to splice the forms is too short (i.e., not long enough to span the entire width of the forms), the unspliced corners of the forms may tend to fold back and become jammed within the printer. It is, therefore, desirable to provide a method and apparatus for splicing continuous pin-feed form which minimizes paper jams resulting from poor splices within high-speed printers.

In the IBM 3800, as in other similar such printers, splicing of the forms must take place within recessed areas of the printer. That is, the new paper must be first threaded up to the splicing station, making sure that the fold of the paper that is in the printer and the fold of the new paper are the same. If the folds are not alike and the splices made, the resulting stack of continuous pin-feed forms will be incapable of being stacked after processing in a conventional continuous forms stacker. A vacuum is then applied to a tape slot, with the splicing tape being placed thereafter in the slot with its adhesive side up. The splice is then made, the vacuum removed, and the printing operation continued. As is evident from this description, not only is the splicing process of continuous pin-feed forms in IBM 3800-type printers complicated through the necessity of first feeding the new paper up to the splicer, but it is also complicated through its requirement to utilize a vacuum system for holding the tape. Furthermore, personnel performing the splicing operation are required to do so in cramped quarters, thus increasing the chances for a poor splice which could result in paper jams. It would, therefore, also be desirable to provide a method and apparatus for splicing continuous pin-feed forms which could be accomplished external to the printer.

One prior art approach to the problem of providing a splicing station external to the printer is marketed by Acme Visible Records, Inc., and is known as a "Laser Feed" system. Such an apparatus and method for feeding a series of continuous pin-feed forms to a high-speed printer, utilizing auxiliary equipment positioned adjacent the printer, is described in U.S. Pat. No. 4,256,248, issued Mar. 17, 1981 to Lapp et al, and its reissue, U.S. Pat. No. Re. 31,210, reissued Apr. 19, 1983. The auxiliary equipment as described therein permits continuous splicing of webbed portions and, thus feeding of a continuous web to the printer, and intermittant removal of the webbed portions in such a manner that the printer may be run continuously without stoppage for feeding or removing the web. However, the apparatus disclosed in U.S. Pat. No. 4,256,248 and U.S. Pat. No. Re. 31,210 is complicated and bulky in nature, taking up virtually the same amount of space as the printer itself. Furthermore, the method as claimed therein requires the sequential splicing of a plurality of stacks of continuous pin-feed forms paper, but does not provide for the accurate placement of such splices to insure that paper jams do not occur. A similarly external but complicated apparatus for splicing continuous pin-feed forms is shown and described in U.S. Pat. No. 4,564,184, issued Jan. 14, 1986 to Rumpel.

SUMMARY OF THE INVENTION

Accordingly, it is a general object of the present invention to provide a method and apparatus for splicing continuous pin-feed forms. More specifically, it is an object of the present invention to provide such a method and apparatus which may be performed external to the printer.

Another object of the present invention is to provide a method and apparatus for quickly and accurately splicing continuous pin-feed forms.

Still another object of the present invention is to provide a method and apparatus for splicing continuous pin-feed forms which minimizes paper jams.

Briefly, these and other objects of the present invention are provided by apparatus for loading a fresh stack of continuous pin-feed forms in a high-speed printer, such as the IBM 3800 or STC 6100, the printers having fed therethrough an expanded stack of continuous pin-feed forms. The printer conventionally includes an input station, a transport station containing a length of continuous pin-feed forms corresponding to a distal end of the expended stack, and an output station, each of the stations being located in a recessed area of the printer. Such apparatus according to the present invention is comprised generally of a means for supporting the fresh stack, a means for transferring the fresh stack upon the support means between a loaded position within the recessed area proximate to the input station, and a splicing position external to the printer, and a means for splicing one end of the fresh stack to the distal end of the expended stack.

In accordance with one important aspect of the present invention, the support means includes a tray slidably engaged upon a pair of track slides disposed in a parallel spaced relationship within the recessed area, both said track slides being extendable from a loaded position within the recessed area proximate to the input station, and a splicing position external to the printer. A method of splicing the fresh stack to the expended stack, in accordance with another important aspect of the present invention, includes extending the tray to its splicing position, providing a splicing means comprised generally of an upright wall portion attached to one side of the tray and a splicing station hingedly coupled to the upright wall portion, wherein the splicing station comprises a splicing plate having formed therein a locating groove and means for dispensing a controlled length of splicing tape. The tape is thereafter dispensed within the locating groove across the splicing plate with its adhesive side oriented upward therefrom. Guide pins on the splicing plate are subsequently used to register the corresponding ends of the fresh and expended stacks in a position centered upon the slicing tape within the locating groove. The tape is then cut, the forms fan-folded, and replaced upon the fresh stack which is thereafter slid back in the recessed area upon the tray.

The foregoing and other objects, features and advantages of the present invention will be better understood from the following more detailed description, when considered in conjunction with the accompanying drawings:

DESCRIPTION OF THE PREFERRED EMBODIMENT

Figure 1:
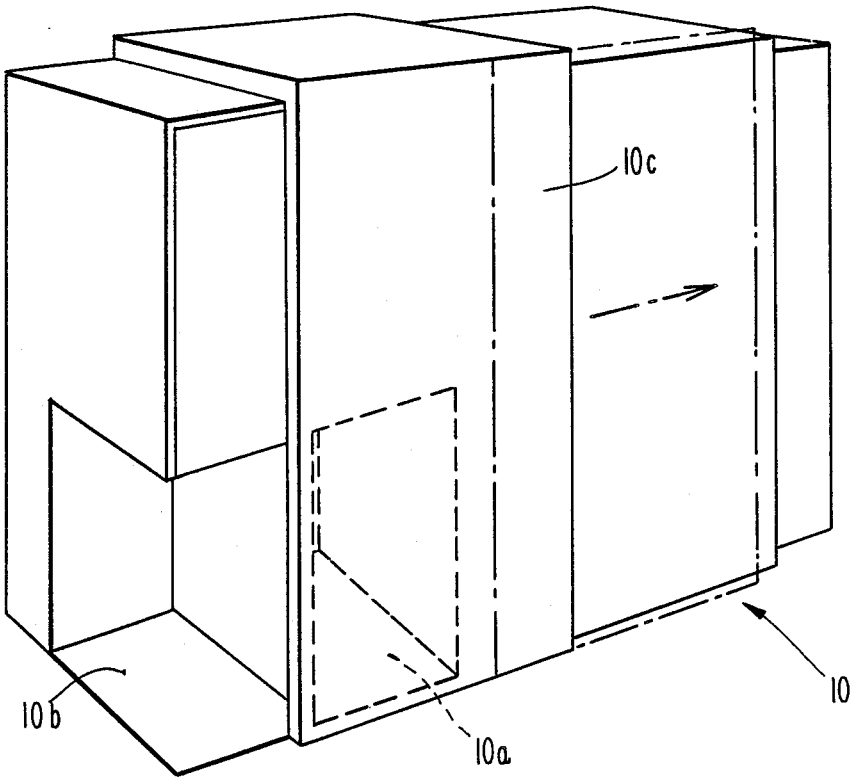
FIG. 1 illustrates a conventional laser electrographic printer capable of utilizing the forms loading tray and splicing station according to the present invention.

Referring now to the drawings, wherein like characters designate like or corresponding parts throughout the several views, there is shown in FIG. 1 a conventional high-speed printer 10, such as the laser electrographic printer marketed by a Storage Technology Corporation as the 6100 Printing Subsystem. The printer 10 is configured for use with continuous pin-feed forms, and generally includes an input station **10*a* and an output station 10*b* located in a recessed area of the printer 10, accessible by a door 10*c*** which is slidable in an open direction as indicated by the arrow.

Figure 2:
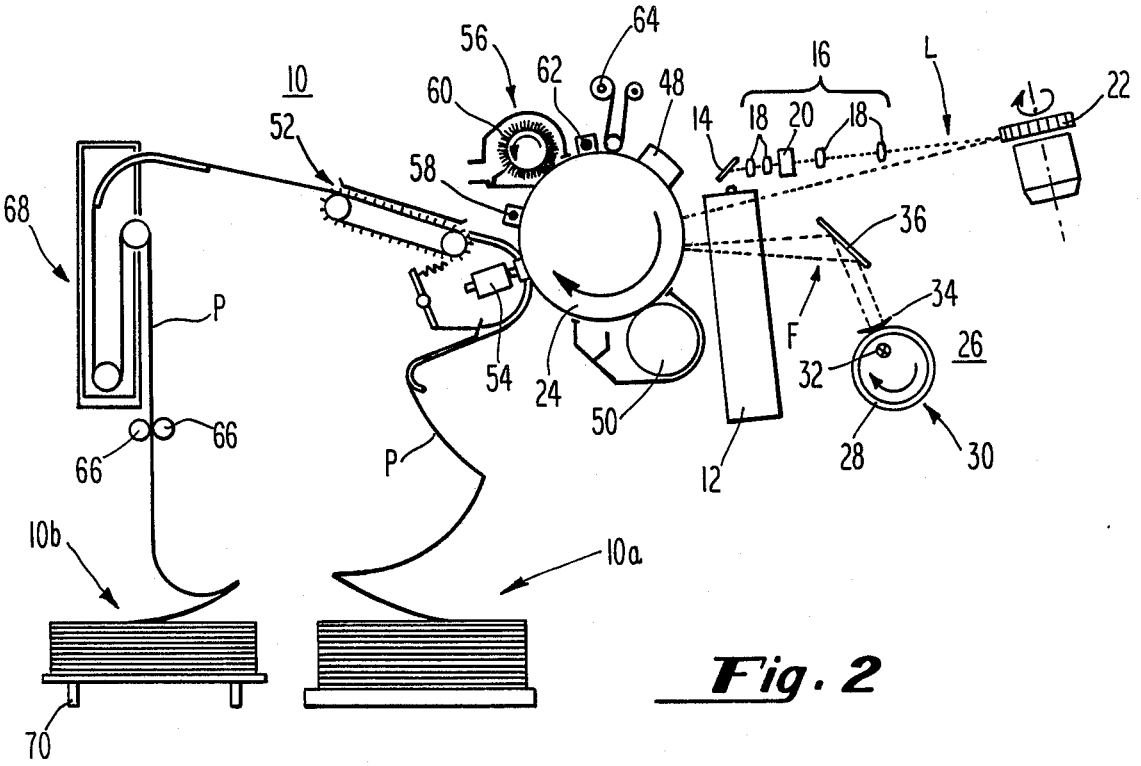
FIG. 2 is a schematic representation of the printer shown in FIG. 1.

As shown more clearly in FIG. 2, a sharply directed laser beam (indicated by the dotted line L) is generated by a helium-neon laser 12, deflected by a laser deflection mirror 14, and directed through a laser optical system 16 comprised generally of a plurality of lenses 18 and an acousto-optical deflector 20. The laser beam L is thereafter reflected horizontally by a rotating 14-face polygon mirror 22 onto a photoconductor drum 24 of the printer 10. The beam L scans from left to right in accordance with data stored in an electronics unit (not shown) which contains a 255-character matrix memory. Every character is conventionally formed by a number of dots and is stored as a dot matrix in the matrix memory, such that the character is read out of memory dot by dot and converted into frequency signals.

The acousto-optical deflector 20 intercepts the laser beam L and, in response to the high frequency signals generated from the character matrix memory, separates the laser beam L vertically into a maximum of five beams and turns these on and off. The individual light dots produced in this manner, with a diameter of approximately 0.006 inches (0.15 mm) are so densely arrayed that solid lines of lettering are produced.

As is conventional, a forms overlay station 26 can eliminate the need for preprinted forms. With this feature, continuous blank paper may be used. A film negative (not shown) of the form to be printed is mounted on a transparent cylinder 28 of a forms overlay drum 30 which is rotated synchronously with the photoconductor drum 24 at the same circumferential speed. The image of the form negative is projected onto the photoconductor drum 24 by means of a fluorescent lamp 32 inside the forms overlay drum 30, a fixed optical system 34, and forms overlay deflector mirror 36. As in the case of the laser beam L, the light path for the image from the forms overlay drum 30 is indicated by dotted line F.

The photoconductor drum 24, covered by a layer of an inorganic semiconductor material, rotates at a constant speed. When the material is in the dark it is a chargeable insulator and under illumination it becomes conducting. The photoconductor drum 24 is charged up in the dark and then discharged at the illuminated spots.

As is conventional, the semiconductor layer is positively charged to several hundred volts by the effect of a charge corotron wire 48. The subseqent illumination of this semiconductor layer by the laser beam L and the image of the form negative discharges the semiconductor in the illuminated areas down to a small residual voltage. A latent charge image is thus stored on the photoconductor drum 24.

This charge image is developed with black powder, called toner, in the developer station 50. The toner is positively charged and is attracted to those areas of the photoconductor drum 24 which were illuminated and thus discharged. The toner is repelled by the non-illuminated areas of the photoconductor drum 24 because they have a charge similar to that of the toner.

In a forms transport station 52, the paper P passes close to the surface of the photoconductor drum 24. The paper P moves at the same speed as the surface of the drum 24. The positively charged toner is drawn by a negatively charged transfer corotron wire 54 from the drum 24 onto the paper P. This step essentially completes the printing process. The surface of the photoconductor drum 24 is then cleared of residual toner as it passes through a cleaning station 56, consisting generally of an initial discharge lamp and cleaning corotron 58, and a cleaning brush 60 operating continuously. A second discharge lamp 62 discharges the photocondctor surface to a predefined state. In addition, the surface is cleaned at intervals by a cleaning fleece 64 and finally the photoconductor surface is charged again for the next print cycle.

In a well-known manner, the printed paper P is transported by friction drive rollers 66 through fusing agent vapor in a fusing station 68. This causes the toner to dissolve and mix into the fine structure of the paper P creating a permanent, fast image which does not cause the paper P to become damp during such process. Unless on-line forms handling equipment is in use, the forms are then fed to an automatic forms stacker 70 located at the output station **10*b*. The stacker 70 is designed so that the first sheet is threaded into it automatically and the following sheets then stacked correctly. When needed, a fresh stacks of paper P may be input, in accordance with the present invention, at the input station 10*a*. Further details relating to the operation of the printer 10** may be found in the Storage Technology Corporation publication P/N 3825118701, "6100 Printing Subsystem Operators Manual and Product Description Manual", which is incorproated herein by reference.

Figure 3A:
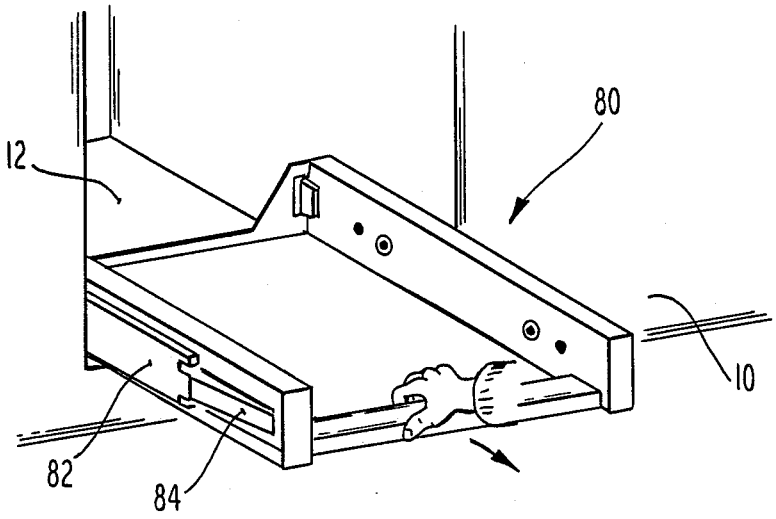
FIGS. 3A and 3B illustrate the forms loading tray according to the present invention.
Figure 3B:
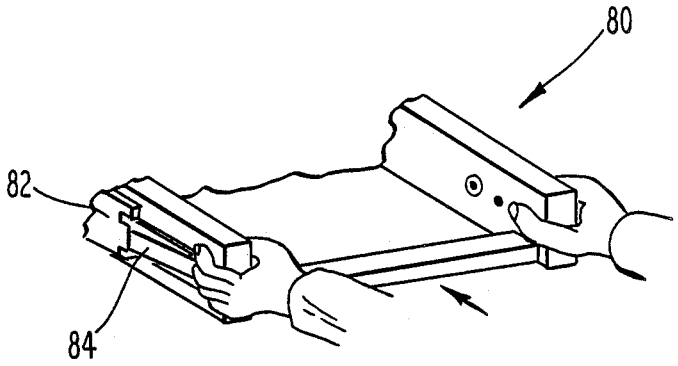

As discussed herein above with reference to the IBM 3800 printer, as well as U.S. Pat. No. 4,256,248, its reissue U.S. Pat. No. Re. 31,210, and U.S. Pat. No. 4,564,184, prior art approaches which have addressed the loading of a fresh stack of paper and its splicing to the previously loaded and expended stack of paper have been deficient primarily due to their inability to ensure jam-free splices, their inaccessibility to splice the paper, as well as their complexity and bulkiness in operation. In order to circumvent such problems, and referring now to FIGS. 3A and 3B, a forms loading tray 80 according to the present invention will be described. The tray 80 provides a means of support for the fresh stack of paper, and it is slidably engaged upon a pair of track slides 82 disposed in a parallel spaced relationship within the input station 10a of the recessed area of the printer 10. Each track slide 82 is extendable from a loaded position within the recessed areas proximate to the input station **10*a*, and a splicing position external to the printer 10 as shown in FIG. 3A. One suitable such slide 82, utilized in a presently preferred embodiment of the invention, is manufactured by Grant Hardware Co. a division of Buildex Inc., West Nyack, N. Y. as part #3330-18. Such a slide 82 include a locking tab 84 which may be lengthened in order to prevent injuries to the hands of an operator when the tray 80** is moved from its splicing position to its loaded position within the recessed area.

Figure 4A:
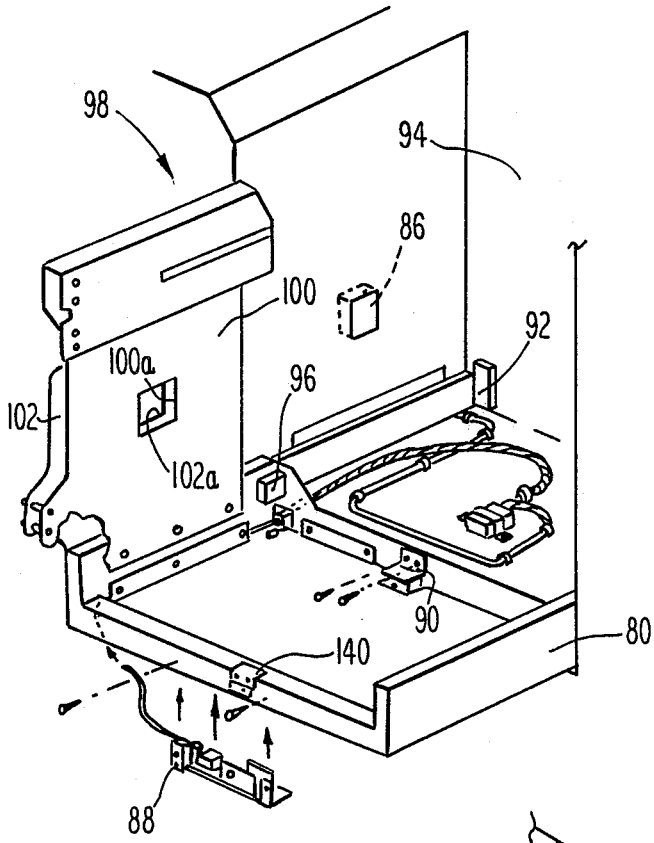
FIGS. 4A and 4B illustrate the sensor assemblies utilized with the forms loading tray according to the present invention.
Figure 4B:
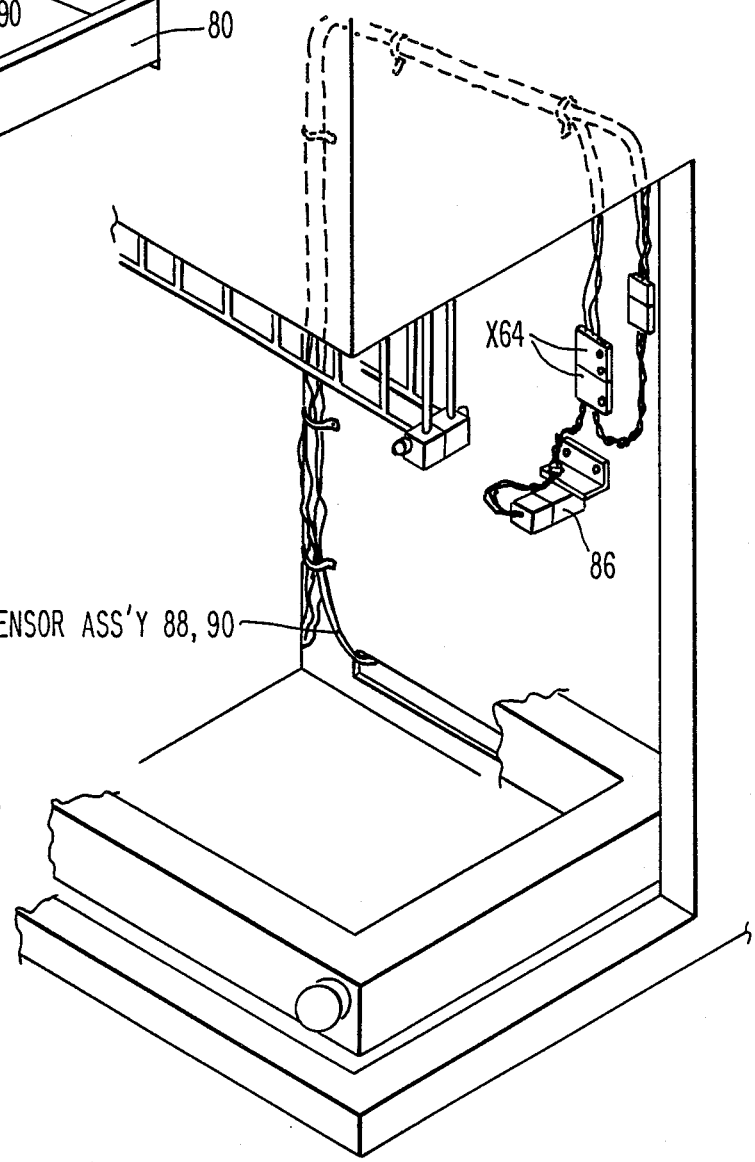
Figure 5:
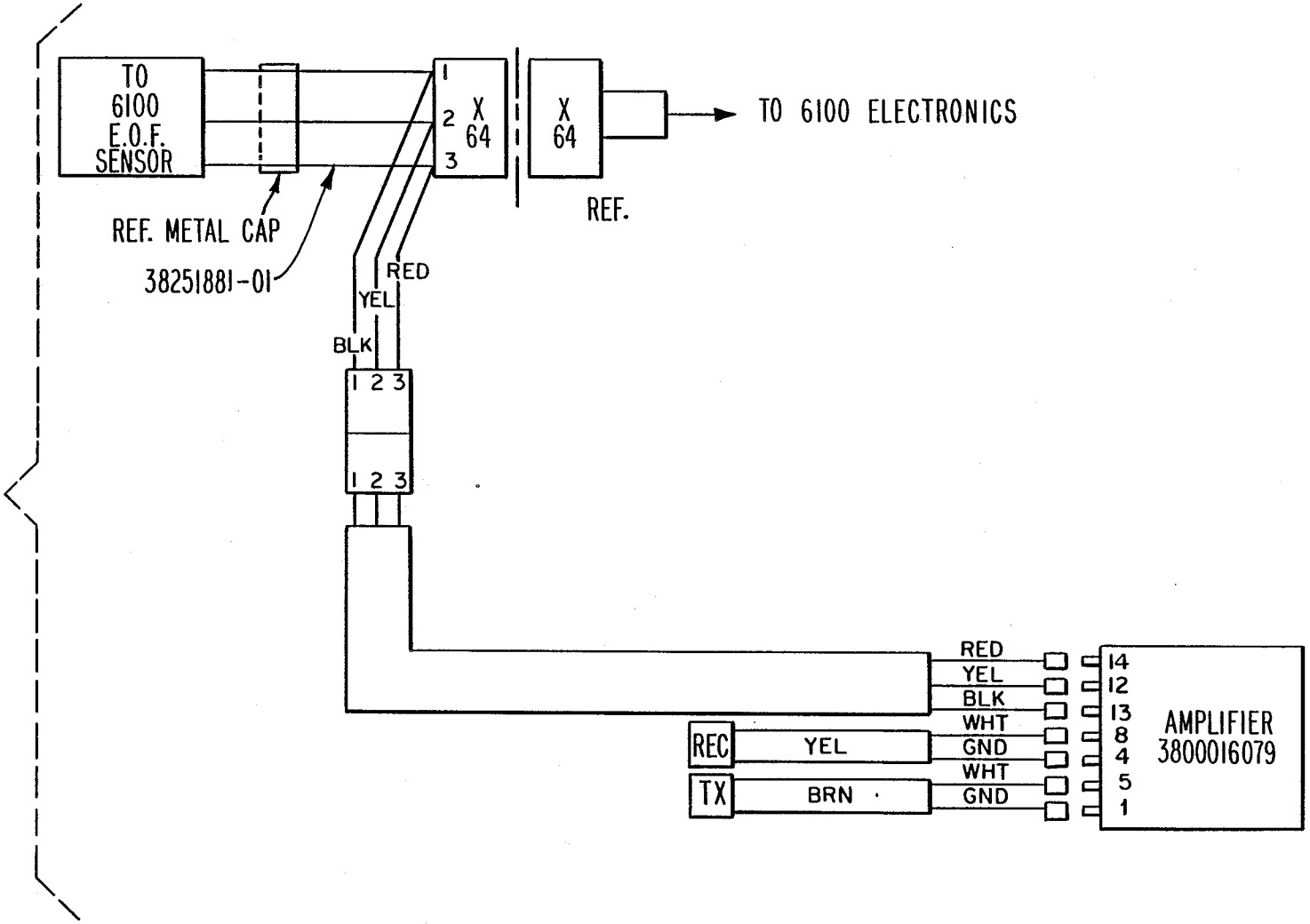
FIG. 5 schematically illustrates the sensors shown in FIGS. 4A and 4B.

Referring now to FIGS. 4A and 4B, a further aspect of the present invention will now be described. In order to detect when a predetermined number of pages remain upon the tray 80, for example 25 to 50 pages, the conventional end-of-forms sensor 86 (FIG. 4B) utilized in the 6100 Printing Subsystem is modified through the inclusion of a front sensor assembly 88 attached to the forward portion of the tray 80 and a rear assembly 90 attached to the rear of the tray 80. The rear sensor assembly 90 includes a means for emitting a beam of light which is directed across the fresh stack loaded upon the tray, while the front sensor assembly includes a means for receiving the beam of light, such that during normal operation the beam will be interrupted by the stack of paper, but upon the occurrence of from 25 to 50 pages remaining in the stack will permit the beam to be received by the front sensor assembly 88 thereby completing the circuit. Referring now also to FIG. 5, a schematic diagram of the sensor assembly as it is incorporated with the end-of-forms sensor 86 is shown. The tray 80 is further provided with a latching means to hold it within the recessed area in the loaded position, the latching means being comprised generally of a pair of striker plates 92 attached to an innermost wall 94 of the recessed area, and a pair of magnetic catches 96 attached to the tray 80 in a spaced relationship corresponding to the striker plates 92. One suitable such striker plate 92 and magnetic catch 96 is manufactured by Southco, Inc. of Concordville, Penna. as parts #02-14-201-14 and 02-30-121-10, respectively.

Figures 6A, 6B, 6C:
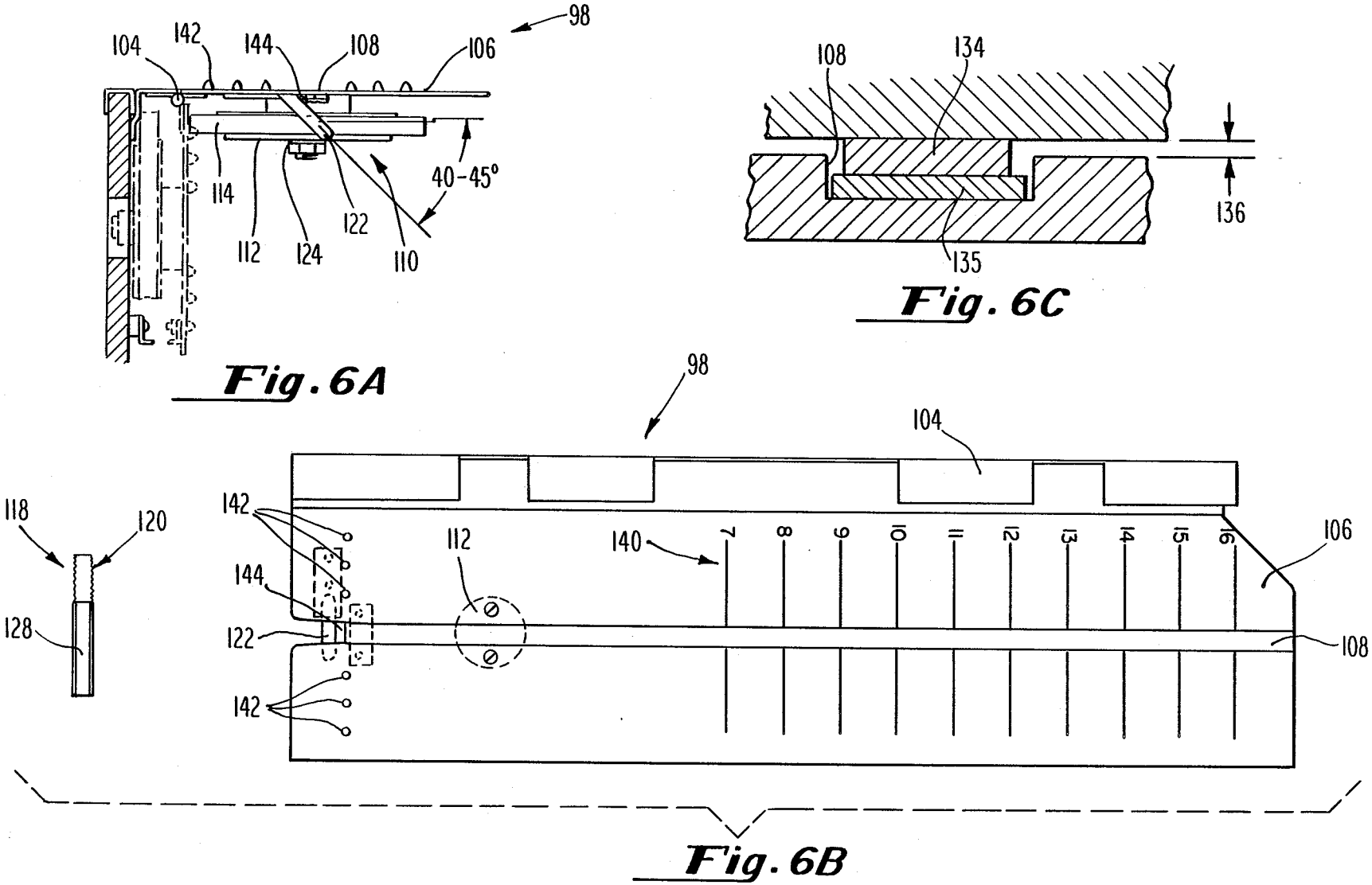
FIGS. 6A through 6C illustrate the splicing station according to the present invention.

As is shown in FIG. 4A in conjunction with FIGS. 6A through 6C, a splicing station 98 is hingedly coupled to an upright wall portion 100 attached to one side of the tray 80. Also attached to the wall portion 100 is a forms retaining plate 102 which may be utilized according to the method of the present invention to hold a fan-folded section of continuous pin-feed forms for splicing upon the splicing station 98. The wall portion 100 as well as the forms retaining plate 102 have formed therein respective holes **100*a* and 102*a* which permit the end-of-forms sensor 86** to be used.

The splicing station 98, as shown in FIGS. 6A through 6C, is coupled to the wall portion 100 by a hinge 104, thus permitting it to be stored in a flat position against the wall portion 100 (shown in phantom) or deployed in its working position external to the printer 10 as shown in FIG. 6A. The splicing station 98 is comprised generally of a splicing plate 106 having formed therein a locating groove 108, means for dispensing 110 a controlled length of splicing tape including a spool hub 112 mounted to the underside of the splicing plate 106, a spool 114 of splicing tape mounted on the spool hub 112, means for tensioning 116 the spool 112, and means for clamping 118 the controlled length of splicing tape within the locating groove 108, wherein the clamping means 118 includes means for cutting off 120 the controlled length. The tension means 116 according to the present invention includes an angled pin 122 attached to the underside of the splicing plate 106, oriented relative to the locating groove 108, and angled from between 40 and 45 degrees therefrom to redirect the tape from the spool 114 along the locating groove 108 with its adhesive side oriented upward from the splicing plate 106 in the locating groove 108. Spring means, such as a wave spring washer 124, is coupled to the spool hub 112 and adapted to bias the tape dispensed therefrom. Also attached in close proximity to the splicing station 98 is a clamping/cutoff tool comprising the clamping means 118 which includes a magnet 128 having mounted thereto a serrated blade comprising the cutoff means 120 formed to cut the tape. With the splicing tape clamped against the top surface of the splicing plate 106 outside of the locating groove 108, the tension that can be exerted on the tape by the wave spring washer 124 before the clamping/cutoff tool 118 starts to slip is approximately 0.57 lbs.. However, with the tape clamped in the locating groove 108 having a controlled depth, the tension exerted by the wave spring washer 124 can be increased to approximately 1.43 lbs. before the clamping/cutoff tool 118 starts to slip, an increase in tension of 2.5 times. As shown in FIG. 6C, the controlled depth of the locating groove 108 is provided by milling the locating groove 108 to a depth of from 0.006 to 0.007 inches, thereafter applying a single layer of color-contrasting marking tape 135 having a thickness of from 0.0035 to 0.004 inches. As a result, when conventional splicing tape 134 is positioned within the locating groove 108 upon the marking tape 135, a controlled air gap 136 of from 0.003 to 0.002 inches is provided between the top surface of the splicing plate 106 and the clamping/cutoff tool 118. One suitable such splicing tape 134 is manufactured by 3M as number 914, is approximately 5/16 inch wide, and is from 0.0038 to 0.004 inches thick.

Figure 7A:
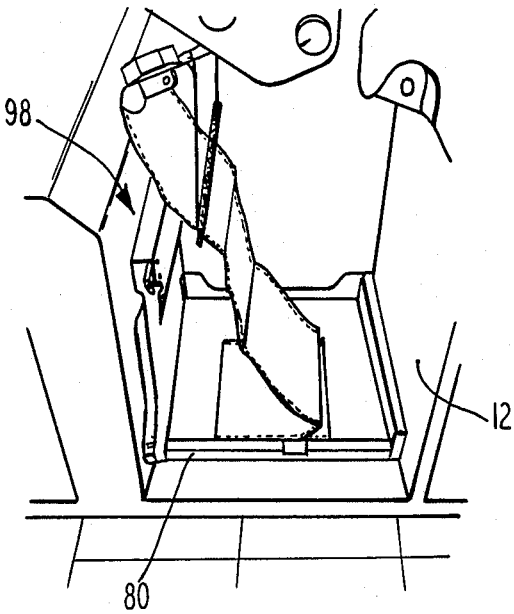
FIGS. 7A through 7Q illustrate the method of splicing continuous pin-feed form according to the present invention.
Figure 7B:
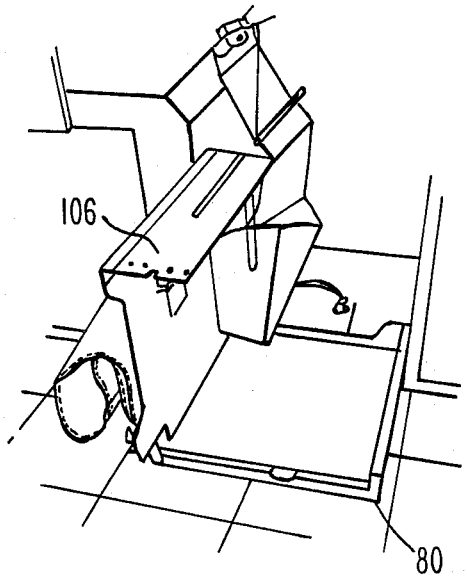
Figure 7C:
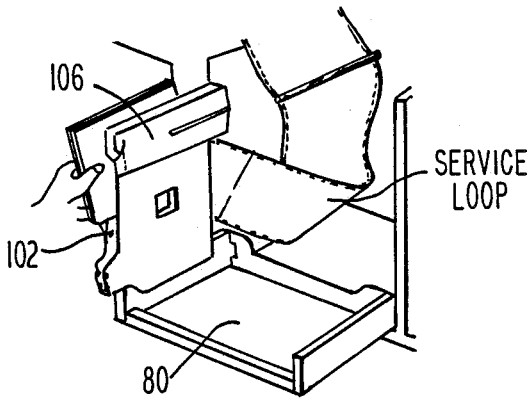
Figure 7D:
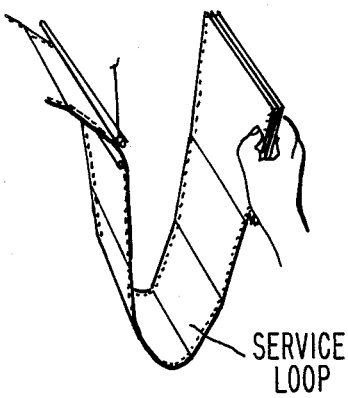
Figure 7E:
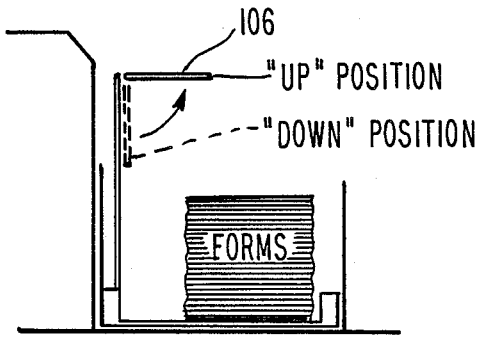
Figure 7F:
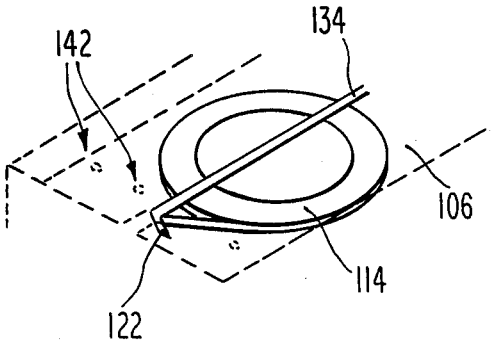
Figure 7G:
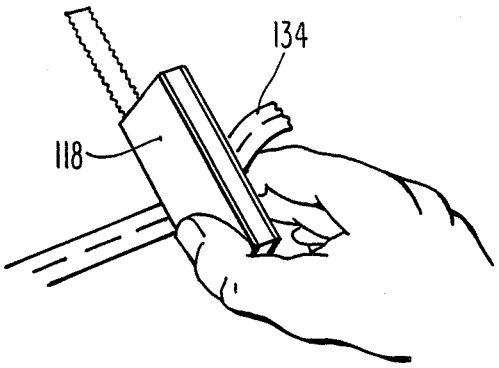
Figure 7H:
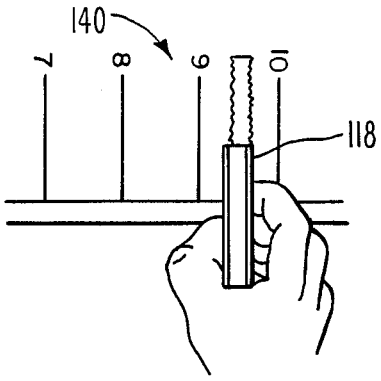
Figure 7I:
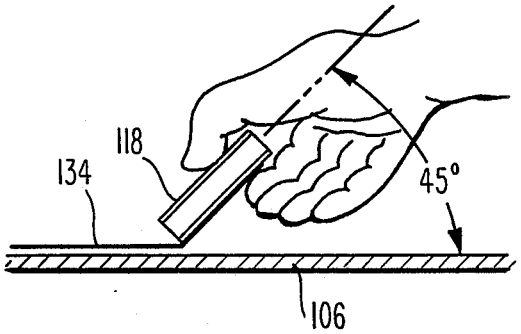
Figure 7J:
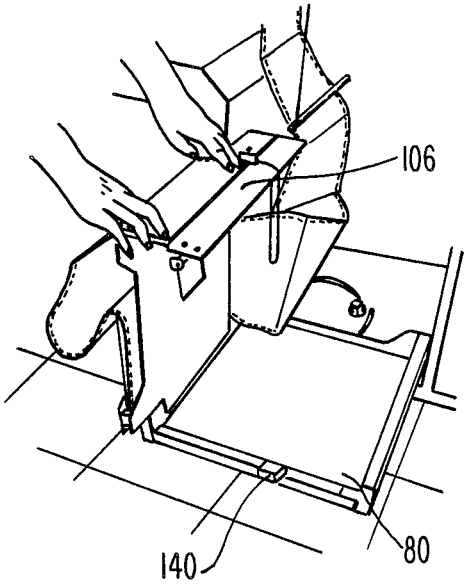
Figure 7K:
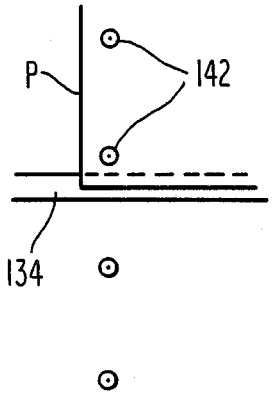
Figure 7L:
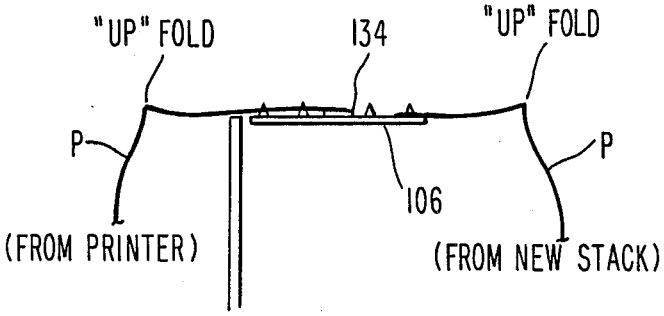

A method of loading a fresh stack of paper and splicing the fresh stack to an expanded stack within the recessed area of the printer 10 will now be explained with reference to FIGS. 7A through 7Q. In a "Run" mode, the printer 10 will be deactivated conventionally through the end-of-forms sensor 86. However, in a "Splicing" mode selectable by a switch 140 (FIG. 4A) situated at the front of the tray 80, the printer 10 will stop with approximately 25 to 50 sheets of paper remaining in the tray 80 as shown in FIG. 7A. As used herein, the terms "forms" and "sheet" and "page" may be used interchangeably to connote single portions of the continuous pinfeed forms that constitute the stack of folded web sheets. A single form or sheet or page, therefore, is a portion of the stack that is between an adjacent pair of folds along the length of the continuous pin-feed forms. The operator then lifts the forms out of the tray with his right hand, and pulls the forms loading tray 80 with its attached splicing station out to the fully extended or loading position with his left hand as shown in FIGS. 7B and 7C. Still holding the forms with the right hand, the operator allows from 3 to 4 folds to fall, thus creating a service loop as shown in FIG. 7D.

The service loop is subsequently brought through the opening between the printer frame and the left side of the splicing station (FIG. 7C, being careful not to put a "reverse twist" in the forms which could cause the splicing of the back of the form in the printer 10 with the front of the form from the fresh stack. Thereafter, the operator grasps the main body of the forms with is left hand and places it in the forms holder located on the left side of the splicing station. A fresh stack of continuous pin-feed forms is then loaded upon the forms loading tray 80, with the splicing plate being raised from its "down" position to its "up" position as shown in FIG. 7E. Splicing tape 134 from the spool 114 is pulled up around the underside of the angled pin 122 on the front of the splicing plate 106 as shown in FIG. 7F, while the distal end of the tape 134, sticky side up, is wrapped around the bottom of the clamping/cutoff tool 118 as shown in FIG. 7G. A controlled length of the splicing tape 134 is pulled off to the spool 114, parallel with the splicing plate 106, and drawn to the number of a scale 140 on the splicing plate 106 that is equal to or larger than the forms width being used. For example, as shown in FIG. 7H, the clamping/cutoff tool 118 for an 8.5 inch wide form would set at approximately the nine inch mark. The clamping/cutoff tool 118 may be subsequently angled at approximately 45° as shown in FIG. 7I, slid back an forth until the splicing tape covers the white marking tape on the splicing plate 106, tensioned, and released to hold the splicing tape within the locating groove 108.

Referring again to FIG. 6B, in conjunction with FIGS. 7J and 7K, a typical splicing operation will now be described. Situated perpendicularly to the locating groove 108 upon the top surface of the splicing plate 106 are a plurality of locating pins 142, spaced one from the other a distance equal to the pin-feed holes in conventional continuous pin-feed forms. Each locating pin 142 is preferably press fit within the splicing plate 106, having its respective back side spot welded thereto. In order to commence the actual splicing operation, as shown in FIGS. 7J and 7K, the last form that was in the printer is placed on top of the splicing plate 106 registered to the locating pins 142 on the left side of the splicing plate 106. The bottom edge of the form is then suitably centered on the splicing tape, the operator thereafter grasping the rear edge of the form, slightly tensioning it, centered on the splicing tape, and pressed down against the splicing tape for the full forms width.

It should be noted at this juncture that in order to assure reliable stacking, the folds of the forms must match before splicing them together. The opeator must first observe the fold on the left side of the splicing tape. If it is "up", as shown in FIG. 7L, then the fold on the right side of the splicing tape (i.e., from the fresh stack) must also be "up". As is apparent, each form could just as well be oriented "down", as long as they are both oriented in the same direction. If the forms do not match, the operator must tear off the first sheet from the fresh stack in order to match the forms.

Figure 7M:
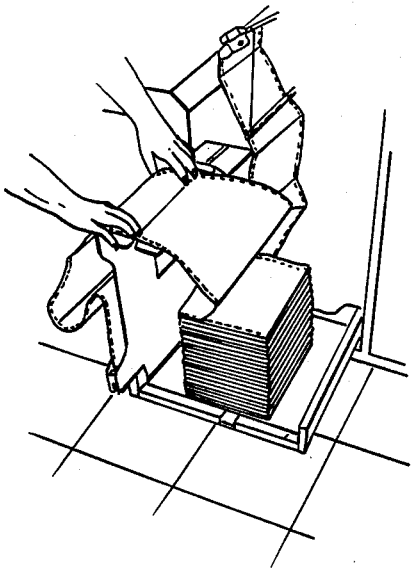
Figure 7N:
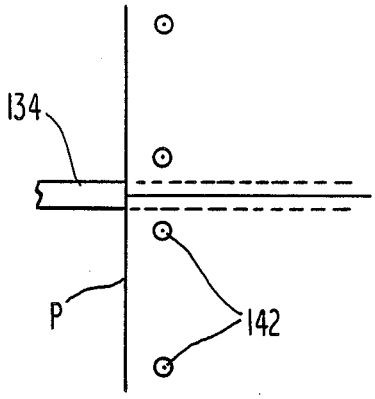
Figure 7O:
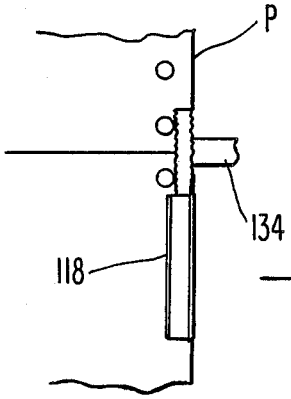

Referring now to FIGS. 7M and 7N, the next subsequent step for the operator is to place the top form from the fresh stack on the locating pins 142 on the right side of the splicing plate 106 with the top edge of the form centered on the splicing tape. As before, the operator must then grasp the rear edge of the form, slightly tensioning the form, centered on the tape, and press the form against the splicing tape 134 for the full forms width. The clamping/cutoff tool 118 is then visually positioned to adjust its serrated blade so that the back edge of the blade is flushed with the back edge of the form as shown in FIG. 70. Any excess tape is torn off from the right side of the clamping/cutoff tool, and the clamping/cutoff tool may be stored for its next use.

Figure 7P:
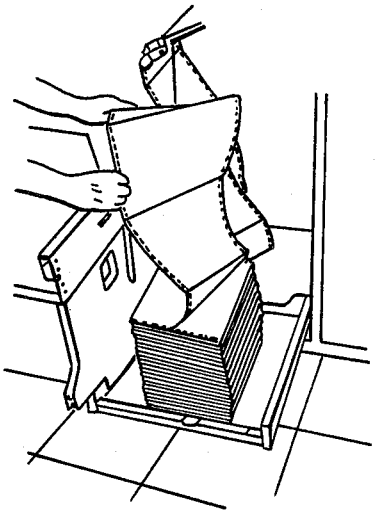
Figure 7Q:
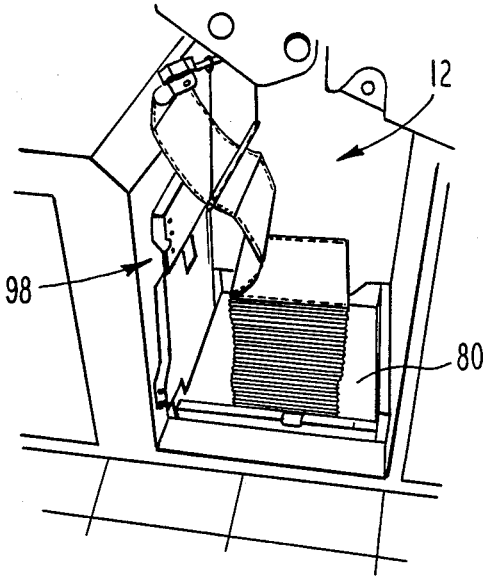

The operator must then grip the tape spool 114 and rotate it, in this instance counterclockwise, in order to shear the splicing tape flush with the front edge of the form by drawing it over a serrated blade 144 (FIG. 6B) located at the underside of the splicing plate 106. As shown in FIG. 7P, the operator may then remove the spliced forms from the locating pins 142, rotate the splicing plate 106 to the "down" position, and press the front edge of the forms and the splicing tape together with his thumb and forefinger. The forms may thereafter be fan folded with the forms in the forms holder, placed onto the top of the fresh stack, and placed within the recessed area in the "loaded" position by unlocking the lock tabs 84 of the track slides 82 and slowly retracting the forms loading tray 80 within the input station 12 as shown in FIG. 7Q.

Although particular embodiments of the invention have been shown and described and various modifications suggested, it will be appreciated that other embodiments and modifications which fall within the true spirit and scope of the invention as set forth in the appended claims will occur to those of ordinary skill in the art.

What is claimed is

1. Apparatus for loading a fresh stack of continuous pin-feed forms in a high-speed printer having fed therethrough an expended stack of continuous pin-feed forms, wherein the printer includes an input station, a transport station containing a length of continuous pin-feed forms corresponding to a distal end of the expended stack, and an output station, each of the stations being located in a recessed area of the printer, comprising:

means for supporting the fresh stack;

means for transferring the fresh stack upon said support means between a loaded position within the recessed area proximate to the input station, and a splicing position external to the printer, wherein said transfer means comprises a pair of track slides disposed in a parallel spaced relationship within the recessed area, both said track slides being extendable from the loaded position to the splicing position; and means for splicing one end of the fresh stack to the distal end of the expended stack.

2. The apparatus according to claim 1, wherein said support means comprises a tray slidable engaged upon said track slides.

3. The apparatus according to claim 2, wherein said track slides each further comprises a means for locking said tray in said splicing position.

4. The apparatus according to claim 2, further comprising means for latching said tray in said loaded position.

5. The apparatus according to claim 4, wherein said latch means comprises:

a pair of striker plates disposed within the recessed area; and a pair of magnetic catches attached to said tray in a spaced relationship corresponding to said striker plates;

wherein said catches engage said striker plates through magnetic attraction when said tray is in said loaded position.

6. Apparatus for loading a fresh stack of continuous pin-feed forms in a high-speed printer having fed therethrough an expended stack of continuous pin-feed forms, wherein the printer includes a power source, an input station, a transport station containing a length of continuous pin-feed forms corresponding to a distal end of the expended stack, and an output station, each of the stations being located in a recessed area of the printer, comprising:

means for supporting the fresh stack;

means for transferring the fresh stack upon said support means between a loaded position within the recessed area proximate to the input station, and a splicing position external to the printer;

means for splicing one end of the fresh stack to the distal end of the expended stack;

means for detecting when a predetermined length of the expended stack is remaining in the input station; and means for deactivating the printer upon the detection of said predetermined length by said detecting means.

7. The apparatus according to claim 6, wherein said predetermined length is less than 50 sheets.

8. The apparatus according to claim 7, wherein said predetermined length is greater than or equal to 25 sheets.

9. The apparatus according to claim 6, wherein said deactivation means comprises:

means for emitting a beam of light, said emitting means being attached to said support at one side of said fresh stack;

means for receiving said beam of light, said receiving means being attached to said support means opposite said emitting means at the other side of said fresh stack, wherein said beam of light is interrupted by said fresh stack until the occurrence of said predetermined length; and switch means coupled between said receiving means and the power source of the printer, said switch means being responsive to the reception of said beam of light by said receiving means.

10. Apparatus for loading a fresh satck of continuous pin-feed forms in a high-speed printer having fed therethrough an expended stack of continuous pin-feed forms, wherein the printer includes an input station, a transport station containing a length of continuous pin-feed forms corresponding to a distal end of the expended stack, and an output station, each of the stations being located in a recessed area of the printer, comprising:

means for supporting the fresh stack;

means for transferring the fresh stack upon said support means between a loaded position within the recessed area proximate to the input station, and a splicing position external to the printer;

means for splicing one end of the fresh stack to the distal end of the expended stack, said splicing means comprising an upright wall portion attached to one side of said support means, and a splicing station hingedly coupled to said upright wall portion; and a forms holder attached to said upright wall portion opposite said fresh stack, said forms holder being adapted to hold a fan-folded portion of said predetermined length.

11. Apparatus for loading a fresh stack of continuous pin-feed forms in a high-speed printer having fed therethrough an expended stack of continuous pin-feed forms, wherein the printer includes an input station, a transport station containing a length of continuous pin-feed forms corresponding to a distal end of the expended stack, and an output station, each of the stations being located in a recessed area of the printer, comprising:

means for supporting the fresh stack;

means for transferring the fresh stack upon said support means between a loaded position within the recessed area proximate to the input station, and a splicing position external to the printer;

means for splicing one end of the fresh stack to the distal end of the expended stack, said splicing means including an upright wall portion attached to one side of said support means, and a splicing station hingedly coupled to said upright wall portion, said splicing station including a splicing plate having formed therein a locating groove, and means for dispensing a controlled length of splicing tape, wherein said dispensing means comprises:

a spool hub mounted to the underside of said splicing plate;

a spool of splicing tape mounted on said hub;

means for tensioning said spool; and means for clamping said controlled length within said locating groove, said clamping means including means for cutting off said controlled length.

12. The apparatus according to claim 11, wherein said tension means comprises:

an angled pin attached to the underside of said splicing plate and adapted to redirect the tape from said spool along said locating groove with its adhesive side oriented upward from said splicing plate in said locating groove; and a spring coupled to said spool hub and adapted to bias the tape dispensed therefrom.

13. The apparatus according to claim 12, further comprising a serrated blade attached to said splicing plate proximate to said spool and adapted to cut one end of the tape dispensed therefrom.

14. The apparatus according to claim 12, wherein said locating groove further comprises:

a marking tape attached to said locating groove at its bottom thereby reducing the depth thereof to provide a controlled air gap above said splicing plate upon the introduction of said splicing tape within said locating groove, said marking tape being adapted to be visually contrasting with said splicing plate; and a scale closely juxtaposed to said locating groove, said scale indicating a selected forms width.

15. The apparatus according to claim 14, wherein said clamping means comprises:

a magnet attractive to said splicing plate, said magnet having an attractive force sufficient to clamp said controlled length against the bias of said tension means across said controlled air gap; and a serrated blade attached to said magnet for cutting off said controlled length.

16. Apparatus for loading a fresh stack of continuous pin-feed forms in a high-speed printer having fed therethrough an expanded stack of continuous pin-feed forms, wherein the printer includes an input station, a transport station containing a length of continuous pin-feed forms corresponding to a distal end of the expended stack, and an output station, each of the stations being located in a recessed area of the printer, comprising:

means for supporting the fresh stack;

means for transferring the fresh stack upon said support means between a loaded position within the recessed area proximate to the input station, and a splicing position external to the printer;

means for splicing one end of the fresh stack to the distal end of the expended stack, said splicing means including an upright wall portion attached to one side of said support means, and a splicing station hingedly coupled to said upright wall portion, said splicing station including a splicing plate having formed therein a locating groove, and means for dispensing a controlled length of splicing tape, wherein said splicing plate further comprises a plurality of locating pins extending upward from said splicing plate, said locating pins being adapted to register with respective holes in the continuous pin-feed forms of said fresh and expended stacks thereby orienting same for splicing upon said splicing plate.

17. In a continuous pin-feed forms printer having fed therethrough an expended stack of continuous pin-feed forms, apparatus for splicing a fresh stack of continuous pin-feed forms to the expended stack comprising:

a splicing station extendible from the printer, said station including a splicing plate having formed therein a locating groove, and a means for dispensing a controlled length of splicing tape;

means for detecting when a predetermined number of pages of the expended stack remains unfed through the printer; and means for deactivating the printer upon the detection of said predetermined number of pages by said detecting means.

18. The apparatus according to claim 17, wherein said detecting means comprises a photosensor adapted to detect a presence of said predetermined number of pages, said predetermined number of pages comprising between 25 and 50 pages.

19. The apparatus according to claim 17, wherein said dispensing means comprises:

a spool hub mounted to the underside of said splicing plate;

a spool of splicing tape mounted on said spool hub;

means for tensioning said spool;

a marking tape attached to said locating groove at its bottom thereby reducing the depth thereof to provide a controlled air gap above said splicing plate upon the introduction of said splicing tape within said locating groove, said marking tape being adapted to be visually contrasting with said splicing plate;

means for clamping said controlled length within said locating groove, said clamping means including a magnet attractive to said splicing plate, said magnet having an attractive force sufficient to clamp said controlled length against the bias of said tension means across said controlled air gap and a serrated blade attached to said magnet for cutting off said controlled length; and a scale closely juxtaposed to said locating groove, said scale indicating a selected forms width.

20. The apparatus according to claim 19, wherein said tension means comprises:

an angled pin attached to the underside of said splicing plate and adapted to redirect the tape from said spool along said locating groove with its adhesive side oriented upward from said splicing plate in said locating groove;

a spring coupled to said spool hub and adapted to bias the tape dispensed therefrom; and a serrated blade attached to said splicing plate proximate to said spool and adapted to cut one end of the tape dispensed therefrom.

21. The apparatus according to claim 19, wherein said splicing plate further comprises a plurality of locating pins extending upward from said splicing plate, said locating pins being adapted to register with respective holes in the continuous pin-feed forms of said fresh and expended stack thereby orienting same for splicing upon said splicing plate.

22. A method of splicing one end of a fresh stack of continuous pin-feed forms in a high-speed printer having fed therethrough an expended stack of continuous pin-feed forms, wherein the printer includes an input station, a transport station containing a length of continuous pin-fed forms corresponding to a distal end of the expended stack, and an output station, each of the stations being located in a recessed area of the printer, comprising the steps of:

supporting the fresh stack upon a tray slidably engaged upon a pair of track slides disposed in a parallel spaced relationship within the recessed area, both said track slides being extendable from a loaded position with the recessed area proximate to the input station, and a splicing position external to the printer;

extending said tray to said splicing position;

providing a splicing means, including an upright wall portion attached to one side of said tray and a splicing station coupled to said upright wall portion, wherein said splicing station comprises a splicing plate having formed therein a locating groove and means for dispensing a controlled length of splicing tape;

dispensing within said locating groove across said splicing plate said controlled length with its adhesive side oriented upward from said splicing plate;

guiding the distal end across said splicing plate to center it on said controlled length;

pressing said guided distal end upon said controlled length, thereby adhering same;

matching the folds of the fresh stack with those of the expended stack;

guiding the end of the fresh stack across said splicing plate to center it on said controlled length opposite the distal end;

pressing said guided end of the fresh stack upon said controlled length, thereby adhering same; cutting said controlled length;

fan-folding said spliced ends upon the fresh stack; and returning said tray with the spliced fresh stack thereupon to the loaded position within the recessed area.

23. The method according to claim 22, wherein said providing step further comprises forming a forms holder on said upright wall portion.

24. The method according to claim 22, wherein said dispensing step comprises:

providing a spool of splicing tape on the underside of said splicing plate;

tensioning said spool to bias the tape dispensed therefrom;

adhering the distal end of said biased tape to a clamping tool adapted to be magnetically attractive to said splicing plate;

unreeling said controlled length from said spool; and clamping said controlled length to said splicing plate.

25. The method according to claim 22, wherein said cutting step comprises:

providing a serrated edge upon said splicing plate proximate to said spool;

providing a serrated edge upon said clamping tool; positioning said serrated edge of said clamping tool flush with the edge of the spliced forms;

tensioning said tape with said serrated edge of said clamping tool; and rotating said spool to pull said tape across said serrated edge upon said splicing plate, thereby shearing said tape flush with the other edge of the spliced forms.

26. The method according to claim 22, wherein said guiding steps each comprise:

providing a plurality of locating pins extending upward from said splicing plate said locating pins being spaced to register with respective holes in the continuous pin-feed forms of the fresh and expended stacks;

registering the holes upon said locating pins; and tensioning the form across said controlled length.

27. The method according to claim 26, further comprising the step of removing said spliced forms from said locating pins prior to said fan-folding step.

28. Apparatus for loading a fresh stack of continuous pin-feed forms in a high-speed printer having fed therethrough a major portion of an expended stack of continuous pin-feed forms, wherein the printer includes an input station, a transport station containing an unfed length of continuous pin-feed forms that extends from the major portion of the expended stack and includes a distal end thereof, and an output station, each of the stations being located in a recessed area within the printer, comprising:

tray means for supporting the fresh stack;

track slide means, attached to said tray means, for transferring the fresh stack upon said tray means between a loaded position within the recessed area proximate to the input sation, and a splicing position external to the printer; and means for splicing, at said splicing position, one end of the fresh stack to the distal end of the expended stack; wherein the length of continuous pin-feed forms that extends from the major portion of the expended stack and includes the distal end thereof is adapted to be sufficiently long enough to reach between the transport station and said splicing means when said tray means is transferred to said splicing position.

29. The apparatus according to claim 28, wherein said splicing means comprises:

an upright wall portion attached to one side of said tray means; and a splicing station hingedly coupled to said upright wall portion.

30. The apparatus according to claim 29 wherein said splicing station comprises:

means for dispensing a controlled length of splicing tape; and a splicing plate having formed therein a groove of predetermined depth for receiving said controlled length of splicing tape and locating same to effectively splice the distal end of the expended stack and the fresh stack on said splicing plate.

* * * * *